United States Patent [19]

Pasinski

[11] 4,112,995

[45] Sep. 12, 1978

[54] MULTIPLE OPERATION TRAVERSE APPARATUS AND METHODS OF CONSTRUCTING AND UTILIZING SAME

[76] Inventor: Ralph R. Pasinski, 9204 Basset Ct. West, Livonia, Mich. 48150

[21] Appl. No.: 784,610

[22] Filed: Apr. 4, 1977

[51] Int. Cl.[2] ..... A47H 1/00

[52] U.S. Cl. ..... 160/126; 160/330

[58] Field of Search ..... 160/126, 330

[56] References Cited

U.S. PATENT DOCUMENTS

| | | | |
|---|---|---|---|
| 3,430,678 | 3/1969 | Steck et al. | 160/126 |
| 3,513,900 | 5/1970 | Ronfola | 160/126 |

*Primary Examiner*—Peter M. Caun

*Attorney, Agent, or Firm*—Irving M. Weiner

[57] ABSTRACT

A traverse apparatus providing multiple automatic operation capacities for opening and closing drapes, curtains, and other types of space coverings. The traverse apparatus is employed in conjunction with a standard drapery rod, with three top edge corner portions of the drapes being supported by the traverse apparatus and the remaining top edge portions of the drapes being supported by the standard drapery rod. The traverse apparatus includes three carrier members which cooperate to provide alternative automatic side or center opening and closing of the drapes.

7 Claims, 3 Drawing Figures

MULTIPLE OPERATION TRAVERSE APPARATUS AND METHODS OF CONSTRUCTING AND UTILIZING SAME

BACKGROUND OF THE INVENTION

1. Field of the Invention

The present invention relates generally to a traverse apparatus for readily providing multiple automatic operation capacities for space coverings such as drapes.

In particular, the present invention relates to a traverse apparatus used in cooperation with a standard drapery rod, and expanding the normal opening and closing capacities of space coverings such as drapes by providing alternative automatic side or center opening and closing of the drapes.

The terminology "space coverings" as used herein is intended to connote coverings such as drapes, curtains, etc. and in particular coverings which are employed in pairs, and are adapted to movably cover windows, sliding glass doors, and other such types of spaces which are desired to be covered. The terminology "standard drapery rod" as employed herein is intended to connote any of a wide variety of conventional drapery rods which are available. Such standard drapery rods generally comprise a substantially horizontal track member having vertically disposed downwardly depending support members for receiving drapery hooks disposed adjacent the top edge of the draperies. The support members are slidable within the track member to thus permit the drapes to be manually opened and closed.

2. Description of the Prior Art

Heretofore, there has not been developed any generally acceptable or workable apparatus which lent itself to providing multiple automatic operation capacities for opening and closing space coverings such as drapes. Those devices which have been provided invariably have provided only very limited operational capacities, and in particular have not provided alternative and selective side or center opening and closing capacities for drapes.

Because it is highly desirable that drapes which cover various types of spaces, such as sliding glass windows, be provided with selective alternative side and center opening capacities to afford selective protection from various outdoor light conditions, access to various portions of the window such as the side thereof, variable aesthetic appearances, and a host of other advantages, there has developed a desideratum for an apparatus which affords such selective opening and closing capacities with maximum convenience to the user thereof.

Illustrative of prior art developments are: the "CURTAIN POLE" disclosed in U.S. Pat. No. 1,002,840 issued in 1911 to Harmel; the "TRAVERSE CRANE" disclosed in U.S. Pat. No. 2,516,490 issued in 1950 to Steinmeyer; the "EXTENSIBLE AND CONTRACTIBLE, DRAPERY SUPPORTING STRUCTURE" disclosed in U.S. Pat. No. 3,502,132 issued in 1970 to Hager et al.; and the "PLASTIC MASTER WITH DETACHABLE BATON" disclosed in U.S. Pat. No. 3,743,002 issued in 1973 to Ford.

The present invention eliminates the disadvantages and limited operational capacities attendant conventional prior art techniques, and at the same time provides an apparatus which eminently fulfills the desideratum mentioned hereinabove with a minimum of parts and at a reduced cost of manufacture.

SUMMARY OF THE INVENTION

The present invention provides a traverse apparatus which includes at least one track member disposed substantially between a first position and a second position. First means are operably connected to the track member selectively moving relative to the track member and second means are operably connected to the first means for selectively moving relative to the track member between the first and second positions. Third means are operably connected to the second means for selectively covering and uncovering a space across which the track member is disposed, and fourth means are operably connected to the first, second and third means for selectively controlling the covering and uncovering of the space from the first position, and from the second position, and from a third position disposed between the first and second positions.

In accordance with a preferred embodiment of the present invention, there is provided an apparatus wherein the track member is disposed substantially horizontally adjacent and co-extensive with a standard drapery rod to cooperate therewith. The third means comprises a pair of standard drapes and the second means comprises first, second and third carrier members. The pair of drapes have three top edge corner portions thereof movably supported respectively by the first, second and third carrier members, with the remaining top edge portions of the pair of drapes being movably supported by the standard drapery rod.

It is an object of the present invention to provide a novel apparatus with cooperating first, second, and third carrier members which interact to provide selective and alternative side or center opening and closing capacities of a pair of drapes in response to a suitable pulling force applied to a pull portion of a looped cord by the user of the apparatus.

Another object of the invention is to provide an apparatus wherein the selective and alternative side or center opening and closing capacities of the pair of drapes are effected mechanically and automatically, with minimal effort required by the user.

Other objects and details of the invention will become apparent from the following description, when read in conjunction with the accompanying drawings.

DETAILED DESCRIPTION OF PREFERRED EMBODIMENTS

Figure 1:
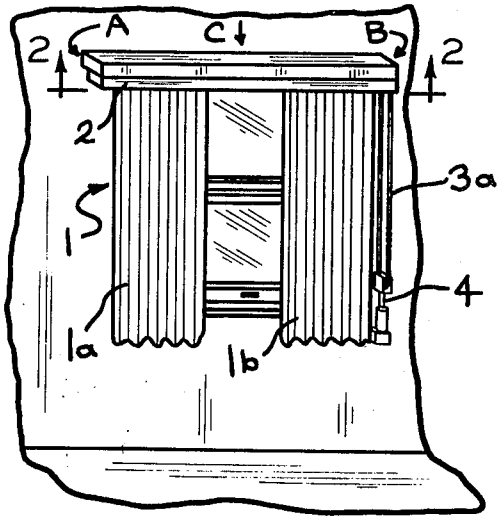
FIG. 1 illustrates a front perspective view of a pair of conventional drapes having a traverse apparatus in accordance with the present invention disposed adjacent the top horizontal edge thereof.

With reference to FIG. 1, there is depicted a pair of conventional drapes 1 including two side drape panels 1*a* and 1*b*. The drapes 1 are supported adjacent the top edge thereof by a standard drapery rod 2 and the traverse apparatus in accordance with the present invention which is disposed rearwardly and out of vision behind the standard drapery rod 2 in FIG. 1. The standard drapery rod 2 and the traverse apparatus in accordance with the invention are disposed substantially horizontally between a first position A and a second position B, with the central portion thereof being indicated at C. A looped cord is disposed adjacent the peripheral edges of the traverse apparatus (FIG. 2) as will be described hereinbelow, with a substantially vertically disposed pull portion 3*a* of the looped cord being disposed adjacent position B within easy reach of the user. A pulley assembly 4 is disposed at the lower end of the pull portion 3*a* of the cord to retain the cord substantially taut in its looped vertical position as depicted.

Figure 2:
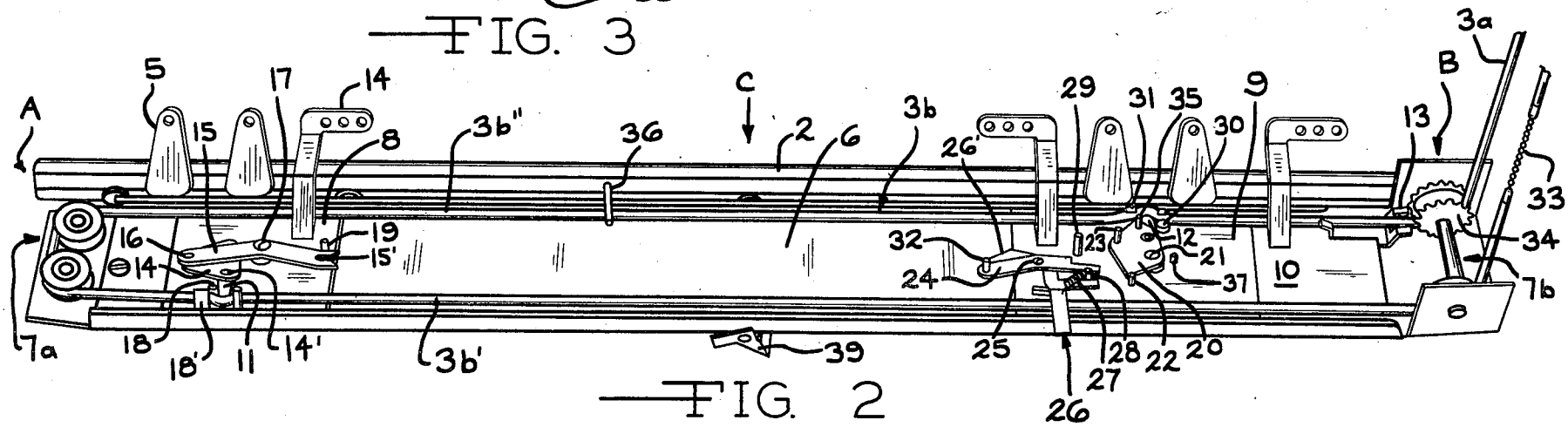
FIG. 2 depicts a view of the traverse apparatus in accordance with the invention, taken along line 2—2 of FIG. 1.

Referring now to FIG. 2, the traverse apparatus in accordance with the invention will now be described in detail. The standard drapery rod 2 is provided with a plurality of drape support members 5 which are slidable within the track of the traverse rod 2 in a conventional manner. As is conventionally known, drapery hooks disposed within the top edge portion of the drape panels 1*a* and 1*b* are received within the apertures disposed in the drape support members 5 to be supported thereby.

The traverse apparatus in accordance with the invention includes a main track member 6. The drape supporting portion 3b of the looped cord is disposed adjacent the peripheral edge portions of the main track 6, and there is provided at each end of the track 6 a pair of pulleys. The pulleys 7*a* disposed adjacent position A are disposed substantially horizontally, while the pulleys 7*b* adjacent position B are disposed substantially vertically. In this manner, it can be seen that upon a pulling force being applied to the pull portion 3*a* of the looped cord, the looped cord will be caused to travel so that a horizontal translation of the portion 3*b* will be effected.

The track 6 has slidably disposed thereon a first carrier member 8, a second carrier member 9, and a third carrier member 10. Each of the carriers 8, 9 and 10 are provided with cord engaging means. On carrier 8, the cord engaging means comprises a clamp 11, on carrier 9 the cord engaging means comprises a clamp 12, and on carrier 10 the cord engaging means comprises a ball-chain engaging member 13, the functioning of which cord engaging means will be described hereinbelow. Each of the carriers 8, 9 and 10 is additionally provided with a drape support member 14 which is adapted to travel in the same horizontal and vertical plane as the support members 5 disposed on the standard drapery rod 2. The support member 14 disposed on carrier 8 will receive a drapery hook disposed on the drape panel closest to position A adjacent the top corner edge thereof which is closest to center C; the support member 14 disposed on carrier 9 will receive a drapery hook disposed on the drape panel closest to position B adjacent the top corner edge thereof which is closest to center C; and the support member 14 disposed on carrier 10 will receive a drapery hook disposed on the drape panel closest to position B adjacent the top corner edge thereof which is closest to position B. The remaining top edge drapery hooks for the two panels will be received and supported by support members 5 of the standard drapery rod 2.

The clamp 11 disposed on carrier 8 is pivotably affixed by pin 14′ to a rounded triangular plate 14 which is in turn pivotably secured by a pin 16 to a release lever 15. The release lever 15 is pivotably secured to the carrier 8 by a screw 17, and is provided with a hooked end portion 15′. In its normal cord-engaging position, the clamp 11 is biased tightly against the cord portion 3*b*′ between a pair of posts 18 and opposing tabs 18′. In this cord-engaging position, the end hook portion 15′ of the release lever 15 rests adjacent a post 19.

The clamp 12 disposed on carrier 9 is pivotally affixed by a pin 38 to a plate 20 which is in turn pivotably secured by screw 21 to the carrier 9. A post 22 is disposed on the carrier 9 to act as a stop against the plate 20, and the plate 20 is provided with a pair of posts 23. In its normal cord-engaging position, the clamp 12 is biased tightly against the cord position 3*b*″ between a post 30 and opposing tabs 31. A release lever 24 is also pivotably secured to the carrier member 9 by a screw 25, with the screw 25 also serving to pivotably affix an L-shaped member 26 to the carrier 9. A spring 27 secured at one end thereof to a post 28 is secured to the L-shaped member 26 to normally retain same in the position depicted in FIG. 2, with the leg 26′ thereof resting adjacent the side edge of the release lever 24. A slightly inwardly curved portion 24′ (FIG. 3) of the release lever 24 rests against the post 28 in the position illustrated in FIG. 2. In addition, a post 29 is disposed on the carrier 9, the function of which post will be understood with reference to FIG. 3 as set forth hereinbelow.

It will be understood that the release lever 15 (carrier 8 and its associated parts, together with the release lever 24 (carrier 9) and its associated parts, together comprise interlocking means for interlocking the carriers 8 and 9 as will be described with reference to FIG. 3. However, in the position indicated in FIG. 2, the carriers 8 and 9 are free to move relative to each other. Because each of the carriers 8 and 9 are engaged with the respective cord portions 3*b*′ and 3*b*″, upon a suitable pulling force being applied to the pull portion 3a of the cord, the carriers 8 and 9 will be caused to be horizontally translated in opposite directions. In this manner, when the cord is pulled to move carrier 8 toward position B, carrier 9 will be translated toward position A, and vice versa. This relative movement of carriers 8 and 9, with their interlocking means in an inoperative position, permits a central opening and closing operation of the drapes in response to a suitable pull on the cord portion 3*a*.

It will be noted that in FIG. 2 the cord engaging member 13 of carrier 10 is disposed substantially horizontally, and in this manner permits the cord portion 3*b* to pass therethrough without engagement therewith. Thus, as the carriers 8 and 9 function to open and close the drapes from the central position C, the carrier 10 remains inoperative and stationarily disposed adjacent position B.

Figure 3:
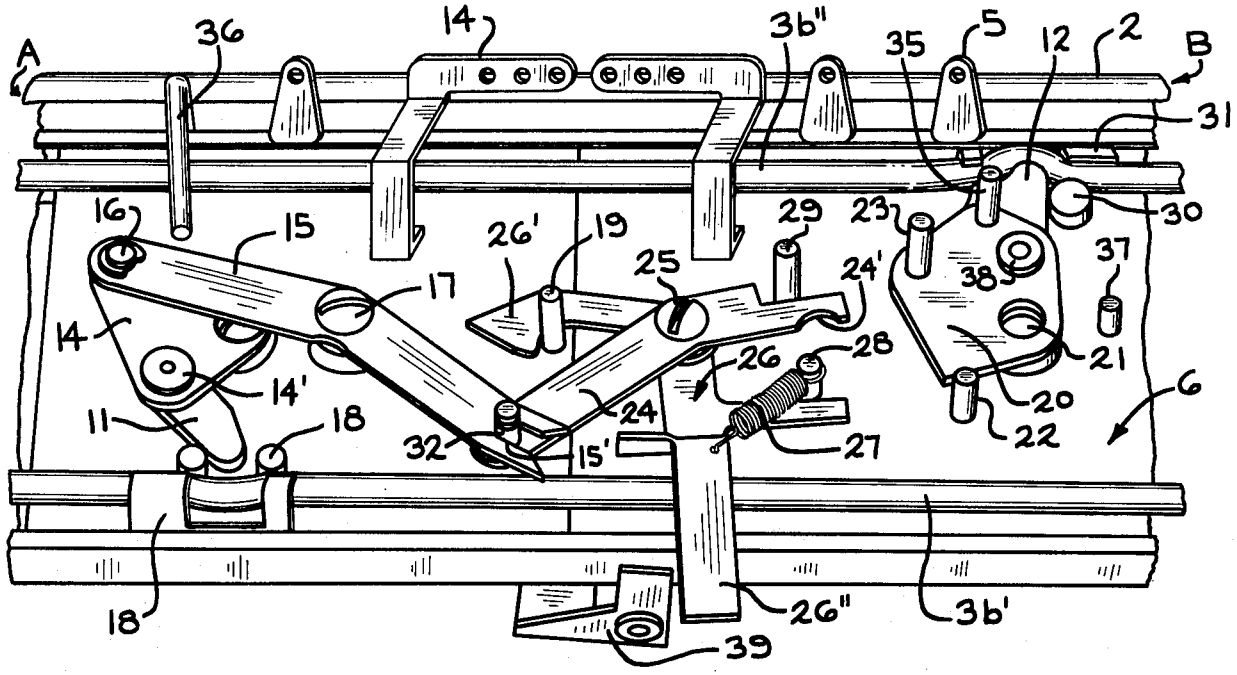
FIG. 3 illustrates a sectional view similar to FIG. 2 showing the first and second carrier members in an interlocked position.

With reference now to FIG. 3, the interlocking of carriers 8 and 9 is illustrated in detail. As the carriers 8 and 9 approach each other from opposite directions and come into close proximity to each other, the pointed tip of leg 26′ of L-shaped member 26 of carrier 9 will abut against the post 19 of carrier 8. This abutting action will occur when the leading edges of the carriers 8 and 9 are proximal, such as for example, approximately $\frac{5}{8}$ inch apart. Although there will be this slight gap ($\frac{5}{8}$ inches) between carriers 8 and 9 at this point, the center corner portions of the drape panels 1*a* and 1*b* will normally extend sufficiently towards each other to bridge the gap from view. Also at this time, the end hook portion 15′ of release lever 15 disposed on carrier 8 will engage a forwardly protruding post 32 disposed on release lever 24 of carrier 9. To interlock the two carriers, the user has merely to exert an additional slight pull on the portion 3*a* of the cord, and the $\frac{5}{8}$ inch gap between the carriers 8 and 9 will be closed, with their respective support members 14 being adapted to slide together without interference such as by one of the members 14 being disposed in a slightly forward vertical plane with respect to the other member 14. As the gap is closed, the pointed tip of leg 26' will slide forwardly to cam up and hook around the post 19 of carrier 8, thus interlocking the carriers 8 and 9. At the same time, the release lever portion 15' of carrier 8 engaged with the post 32 of release lever 24 of carrier 9 will slide towards the cord portion 3b' to complete the interlocking of carriers 8 and 9. In addition, as the release lever portion 15' slides towards cord portion 3b', the triangular plate 14 will be caused to pivot outwardly with the clamp 11 thus releasing its engagement on cord portion 3b', as illustrated in FIG. 3. In the now interlocked position of carriers 8 and 9, the distal end of release lever 24 will abut against the post 29 disposed on carrier 9. The cord engaging means disposed on carrier 9, including clamp 12, will retain its engagement with the cord portion 3b'' during this interlocking operation.

In addition, as the carriers 8 and 9 become interlocked as set forth hereinabove, the ball-chain 33, which is attached to and made integral with the looped cord at a predetermined position, will pass over the pulley 7b (FIG. 2) adjacent position B. It should be noted that the pulley 7b disposed adjacent cord portion 3b'' is additionally provided with a ratchet 34. As the ball-chain 33 passes the pulley 7b with ratchet 34 thereon, it engages the ball-chain engaging member 13 disposed on carrier 10. The carrier 10 is then engaged with the cord portion 3b'' for travel therewith. In this manner, as the user exerts a suitable pull on the cord portion 3a to cuase the interlocked carriers 8 and 9 to travel toward position A with carrier 9 in a cord engaging position with cord portion 3b'' and with carrier 8 in a cord disengaging position to permit cord portion 3b' to travel relative thereto, the carrier 10 will also travel in a like direction toward position A, to thus effect a side opening of the drapes from the position B toward position A. This horizontal translation of the carriers 8, 9 and 10 will continue unitl the post 35 disposed on plate 20 of carrier 9 moves into a proximal position with respect to a stop bar 36 which is mounted to the track member 6 as depicted in FIGS. 2 and 3. The bar 36 is adapted to permit the support members 14 to slide thereunder without interference, and when the post 35 contacts the bar 36 as it is adapted to do by virtue of its relative height, the plate 20 will be caused to pivot about screw 21 and the clamp 12 will in turn pivot about pin 38 inwardly towards plate 20. In this manner, as the bar 36 contacts the post 35, the clamp 12 releases its engagement with cord portion 3b''. Thus, as a continued pull is exerted by the user, the carrier 10 will continue its horizontal translation towards position A, while carriers 8 and 9, both in cord disengaging positions, will remain stationary relative to the cord in a position adjacent the bar 36. The horizontal translation of carrier 10 will continue until the leading edge thereof comes into contact with the edge of carrier 9 proximal thereto. It should be noted that the bar 36 is disposed at a desired location on track member 6 such that when the drapes are opened from the side as described their horizontal translation will terminate proximal to bar 36.

To close the drapes, the user applies a suitable pull on cord portion 3a to effect horizontal translation of carrier 10, engaged by ball-chain 33, back towards position B. The carriers 8 and 9 will remain in their stationary position adjacent bar 36 until the drapery panel disposed proximal to position B and supported at its corners by carriers 9 and 10 becomes substantially taut. At this point, the support member 14 disposed on carrier 9 will be caused to horizontally translate due to the horizontal translation of the taut drapery panel being pulled and translated by the action of carrier 10. As the carrier 9 is thus caused to also translate horizontally toward position B, it will move out of engagement with bar 36 and the cord engaging mechanism will become reengaged as the plate 20 and clamp 12 return to their original cord-engaging position as depicted in FIG. 2. Horizontal translation of the carrier 10 and 9 toward position B will thus be effected, with the carriers 8 and 9 remaining interlocked to thus also translate the carrier 8. This translation will continue as the user applies a suitable pulling force until the carrier 9 becomes proximal to the center position C. At this point, the leg 26'' of release lever 26 will come into contact with a one-way pawl 39 disposed adjacent the lower edge of track 6 as depicted in FIGS. 2 and 3. It should be noted that the one-way pawl 39 permits the leg 26'' to travel thereover without interference as carrier 9 is translated toward position A as above described, however, as the carrier 9 travels towards position B the pawl will abut against leg 26'', thus causing the release lever 26 to pivot upwardly about screw 25. In this manner, the leg 26' of release lever 26 will become disengaged from post 19 of carrier 8, the carriers 8 and 9 will become separated with their respective interlocking means in an inoperative position as depicted in FIG. 2, and the cord engaging means including clamp 11, plate 14 and associated parts will be caused to return to its cord-engaging position, thus reversing the carrier-interlocking operation set forth above with regard to FIG. 3. At the same time as the pawl 39 engages leg 26'', the ball-chain 33 with cord-engaging member 13 will become proximal to ratchet 34 and pulley 7b. At this point, because the ratchet 34 will be rotating in a clockwise direction due to the translation of the looped cord, the member 13 will be pushed back into its horizontal position by the rotating ratchet teeth, and thus the ball-chain 33 will be permitted to translate relative thereto and the carrier 10 will become disengaged from cord portion 3b'' in this manner. Thus, the drapes will be returned to a center opening operational mode until such time that the carriers 8 and 9 are translated to be adjacent as set forth above. In this manner, the user, by varying the pull on the cord portion 3a, can easily selectively control the opening and closing of the drape panels 1a and 1b from either a side opening and closing or a center opening and closing operating capacity.

It should be noted that the cord portion 3a and carrier member 10 with its associated cord engaging parts can be disposed adjacent either position A or position B, depending upon the particular window or space installation. For example, if the drape panels 1a and 1b are employed to cover a side opening sliding glass window which is normally opened adjacent position A, then it would be desirable to have the traverse apparatus in accordance with the invention be disposed in an opposite arrangement to the above-described arrangement.

Also, the various parts of the traverse apparatus are adapted to accommodate various types and sizes of window, drape, and standard drapery rod installations by varying the length of the track member 6, the position of bar 36 and pawl 39, as well as various other dimensioning changes which fall within the scope of the present invention.

The various components of the traverse apparatus are most desirably fabricated of sheet aluminum, various types of sheet metal, plastic, or any other type of substantially rigid material which is suitable therefor.

Although there have been described what are at present considered to be the preferred embodiments of the invention, it will be understood that various modifications may be made therein. The present embodiments are therefore to be considered in all respects as illustrative, and not restrictive. The scope of the invention is indicated by the appended claims rather than by the foregoing description.

I claim:

1. A traverse apparatus comprising:

at least one track member disposed substantially between a first position and a second position, said track member being disposed substantially horizontally adjacent and coextensive with a standard drapery rod to cooperate therewith;

a looped cord operably connected to said track member for selectively moving relative to said track member, said cord having a first drape supporting portion thereof disposed adjacent the peripheral edges of said horizontal track member and having a second pull portion thereof disposed substantially vertically adjacent said second position for selective pulling thereof in opposite directions by a user of said apparatus;

first, second and third carrier members operably connected to said looped cord, said carrier members being adapted to selectively move relative to said track member between said first and second positions;

a pair of standard drapes operably connected to said first, second and third carrier members, said drapes being adapted to selectively cover and uncover a space across which said track member is disposed;

said pair of drapes having three top edge corner portions thereof movably supported respectively by said first, second and third carrier members, with the remaining top edge portions of said pair of drapes being movably supported by said standard drapery rod;

said first, second and third carrier members being adapted to cooperate with said track member and said looped cord to selectively control said covering and uncovering of said space from said first position, and from said second position, and from a third position disposed between said first and second positions proximal the center portion of said track member;

said first carrier member and said second carrier member being adapted to support the two inner top edge corner portions of said pair of drapes, and said third carrier member being adapted to support the outer top edge corner portion of said pair of drapes which is in closest proximity to said second position;

said first carrier member and said second carrier member being provided with interlocking means for permitting said first carrier member and said second carrier member to be interlocked for integral movement thereof relative to said track member; and said third carrier member being adapted to remain stationary relative to said track member and adjacent said second position when said interlocking means provided on said first carrier member and said second carrier member is in an inoperative position.

2. An apparatus according to claim 1, wherein:

said first carrier member, said second carrier member and said third carrier member are each provided with cord engaging means for permitting said members to be selectively interlocked with said cord for movement therewith relative to said track member.

3. An apparatus according to claim 2, wherein:

said cord engaging means provided on said first carrier member is adapted to normally engage a first side of said drape supporting portion of said looped cord, and said cord engaging means provided on said second carrier member is adapted to normally engage the opposite second side of said drape supporting portion of said looped cord to permit said first carrier member and said second carrier member to move in opposite directions when a suitable pulling force is applied by said user to said pull portion of said looped cord.

4. An apparatus according to claim 3, wherein:

said first carrier member and said second carrier member are adapted to contact each other adjacent said third position;

said interlocking means provided on said first carrier member and said second carrier member is adapted to interlock said first carrier member and said second carrier member when said members come into contact with each other adjacent said third position; and said interlocking means being further adapted to disengage said cord engaging means provided on said first carrier member when said interlocking means is in an operative position to permit said first carrier member and said second carrier member to be integrally moved toward said first position when a suitable pulling force is applied by said user to said pull portion of said looped cord.

5. An apparatus according to claim 4, wherein:

said cord engaging means provided on said third carrier member is adapted to engage said second side of said drape supporting portion of said looped cord when said first carrier member and said second carrier member are interlocked for integral movement to permit said first, second and third carrier members to move in the same direction toward said first position when a suitable pulling force is applied by said user to said pull portion of said looped cord.

6. An apparatus according to claim 5, wherein:

said track member is provided with disengaging means stationarily disposed between said first position and said third position for disengaging said cord engaging means provided on said second carrier member when said second carrier member is moved toward said first position and is proximal to said disengaging means.

7. An apparatus according to claim 5, wherein:

said cord engaging means provided on said third carrier member is adapted to disengage said second side of said drape supporting portion of said looped cord when said third carrier member is moved toward said second position when a suitable pulling force is applied by said user to said pull portion of said looped cord and when said third carrier member is disposed proximal to said second position.

* * * * *